US005467170A

United States Patent [19]

Wilson et al.

[11] Patent Number: 5,467,170

[45] Date of Patent: Nov. 14, 1995

[54] REPRODUCTION APPARATUS WITH MULTIPLE MEANS FOR CREATING INCREMENTING ALPHA-NUMERIC PAGE STAMPS

[75] Inventors: James Wilson, Coral Springs, Fla.; Frederick E. Altrieth, III, Scottsville, N.Y.

[73] Assignee: Eastman Kodak Company, Rochester, N.Y.

[21] Appl. No.: 173,299

[22] Filed: Dec. 22, 1993

[51] Int. Cl.[6] ..... G03G 21/00

[52] U.S. Cl. ..... 355/209; 355/200; 355/202; 355/244

[58] Field of Search ..... 355/209, 200, 355/202, 244; 395/155, 156, 161

[56] References Cited

U.S. PATENT DOCUMENTS

| | | | |
|---|---|---|---|
| 3,540,012 | 11/1970 | Ehrman | 395/145 |
| 4,707,121 | 11/1987 | Sawaki et al. | 355/40 |
| 4,734,789 | 3/1988 | Smith et al. | 355/40 X |
| 4,740,818 | 4/1988 | Tsilibes et al. | 355/218 X |
| 4,742,373 | 5/1988 | Nakatani | 355/218 X |
| 4,887,129 | 12/1989 | Shenoy et al. | 355/218 |
| 4,963,932 | 10/1990 | Horvath | 355/218 |
| 4,989,042 | 1/1991 | Muramatsu et al. | 355/202 X |
| 4,992,827 | 2/1991 | Kobayashi et al. | 355/202 |
| 5,113,222 | 5/1992 | Wilson et al. | 355/209 |
| 5,257,074 | 10/1993 | Kamei | 355/244 |
| 5,404,441 | 4/1995 | Satoyama | 395/155 |

*Primary Examiner*—Matthew S. Smith
*Attorney, Agent, or Firm*—William F. Noval

[57] ABSTRACT

A reproduction apparatus for producing a copy of an original with added alpha-numeric characters and/or symbols in a predetermined location on the copy. The apparatus includes an operator control panel having a display screen for indicating certain standard selectable features for producing a copy, with plural displayed options for each feature. First assemblage is provided for altering the display on the screen to indicate a displayed selected option and for generating a first set of signals representing selected options of the standard features. Circuitry is provided for altering the display on the screen to display a set of alpha-numeric characters and/or symbols, and second assemblage for altering the display on the screen to indicate one or more selected alpha-numeric characters and/or symbols and for generating a second set of signals representing selected alpha-numeric characters and/or symbols. Devices responsive to the first and second set of signals produce a copy having the one or more selected alpha-numeric characters and/or symbols in a predetermined location on the reproduced copy.

7 Claims, 9 Drawing Sheets

REPRODUCTION APPARATUS WITH MULTIPLE MEANS FOR CREATING INCREMENTING ALPHA-NUMERIC PAGE STAMPS

BACKGROUND OF THE INVENTION

The present invention relates to electrostatographic reproduction apparatus and methods and more specifically to reproduction apparatus with multiple means for creating incrementing alpha-numeric page stamps on reproduced copies.

In commonly assigned U.S. Pat. No. 5,113,222, issued May 12, 1992, inventors Wilson et al., there is disclosed an electrostatographic reproduction apparatus having an operator control panel having a display screen indicating certain standard selectable features for a copying operation, including copy format, paper supply source, copy quality, magnification and exit location with plural displayed options for each feature. Keys and buttons are provided for altering the display to indicate a displayed selected option for each. For more complex operations, the display may be changed to display various operator selectable special job level features for a copying operation available on a job level basis. The display screen is further alterable to display various operator selectable special page level features for a copying operation specific to reproducing a selected page of a multi-sheet document. Thus, a layered approach is provided in the series of displays from standard features presentation which a casual user would be comfortable using, to a job level features presentation for a more complex reproduction at the job level, to a page level features presentation for designation of specific page level features for selection.

In such electrostatographic reproduction apparatus, it is desirable that means be provided to allow an operator to enter variable alpha-numeric data without requiring a standard full-sized computer keyboard. Furthermore, this input mechanism must be capable of providing for the entry of punctuation, other special characters, and non-English symbols. Previous approaches have used the 12-key telephone-style keypad, where, typically, three letters are assigned to each of the nine or ten numeric keys. This approach has several drawbacks. First, since each key has more than one letter, the user must be able to convey to the system which of the three letters is the intended input. This may require multiple key presses, for example, using the remaining two keys on the 12-key keypad in conjunction with the desired key letter-triad. The user must remember the required sequence in order to assign the desired character. Secondly, the nine or ten keys place a limit of 27–30 possible characters when using key triads. While this may be adequate for English, many non-English languages use special characters and symbols that would exceed this limit. Finally, this approach does not provide for easy error detection.

Other solutions to such problems have not been entirely satisfactory either. Thus, U.S. Pat. No. 4,707,121, issued Nov. 17, 1987, inventors Sawaki et al., discloses a copying apparatus comprising a platen for setting a document thereon and a display device for displaying additional information, such as date or time, in the proximity of the platen. The copying apparatus is capable of copying the additional information displayed by the display device along with the document information. A 10-number keypad is used for inputting numbers to the numerical display. There is no disclosure in this patent of the capability of inputting characters and symbols other than numbers. U.S. Pat. No. 4,742,373, issued May 3, 1988, inventor Nakatani, discloses a copying machine capable of forming characters on copy paper without an input device, such as a word processor keyboard, which would require significant modification to the copying system. The copying system includes an editor which has a digitizing tablet with alpha-numeric characters printed on the tablet. In entering the numerals or the characters, the printed numerals or the printed characters are depressed after depressing a character key. The added alpha-numeric characters are exposed by means of an LED array.

A similar alpha-numeric input device is disclosed in U.S. Pat. No. 4,887,129, issued Dec. 12, 1989, inventors Shenoy et al., and U.S. Pat. No. 4,963,932, issued Oct. 16, 1990, inventor Horvath. As disclosed in the latter patent, a copy system is disclosed in which at least one original document of a set of original documents can be edited. An edit pad is provided which includes a digitizing area and a keyboard area, including a matrix of alpha-numeric characters. Additional text may be furnished to the original document by using a stylus to select the appropriate block in the menu selection area and typing in the desired information by selecting the keys of the keyboard area with the stylus. The additional data may be added to the copy by means of a write system comprising either a laser imaging system or a LED or LCD image bar for exposing the photoconductor. The digitizing tablet data input systems described above are useful for the purposes for which they were intended, but would be more useful if other, operator selectable, alpha-numeric input means were also available.

There is thus a problem in the prior art of providing reproduction apparatus with means for creating incrementing alpha-numeric page stamps, wherein full alpha-numeric input of any language or symbol can be provided without using a standard computer keyboard, wherein the user can see at one time all of the characters that are available for selection, wherein the user can choose that method which best suits his or her needs and level of experience, and wherein the number of keystrokes or user inputs required to create a stamp can be minimized by the user's choice of alpha-numeric character input method.

SUMMARY OF THE INVENTION

According to the present invention, there is provided a solution to the aforementioned problems of the prior art. According to a feature of the present invention, there are provided a set of compatible interaction methods which can be used singly or in combination to provide both the novice and experienced reproduction apparatus operator a rapid and accurate means for entering any number of standard and special symbols without requiring a full-sized computer keyboard.

According to another feature of the present invention there is provided a reproduction apparatus for producing copy, said apparatus comprising:

an operator control panel, said panel including a display screen for indicating on said screen certain standard selectable features for producing a copy, with plural displayed options for each feature, and first means for altering the display on the screen to indicate a displayed selected option and generating a first set of signals representing selected options of the standard features;

means for altering the display on said screen to display a set of alpha-numeric characters and/or symbols, and second means for altering the display on the screen to indicate one or more selected alpha-numeric characters and/or symbols and generating a second set of signals representing selected alpha-numeric characters and/or symbols; and means responsive to said first and second sets of signals for producing a copy having said one or more selected alpha-numeric characters and/or symbols in a predetermined location on said copy.

DETAILED DESCRIPTION OF THE PREFERRED EMBODIMENTS

Because electrostatographic reproduction apparatus 1 are well-known, the present description will be directed in particular to elements forming part of or cooperating more directly with the present invention. Apparatus not specifically shown or described herein are selectable from those known in the prior art. Particular reference is made to U.S. Pat. No. 4,740,818 and U.S. Pat. No. 5,113,222, the contents of which are incorporated herein by reference.

Figure 1:
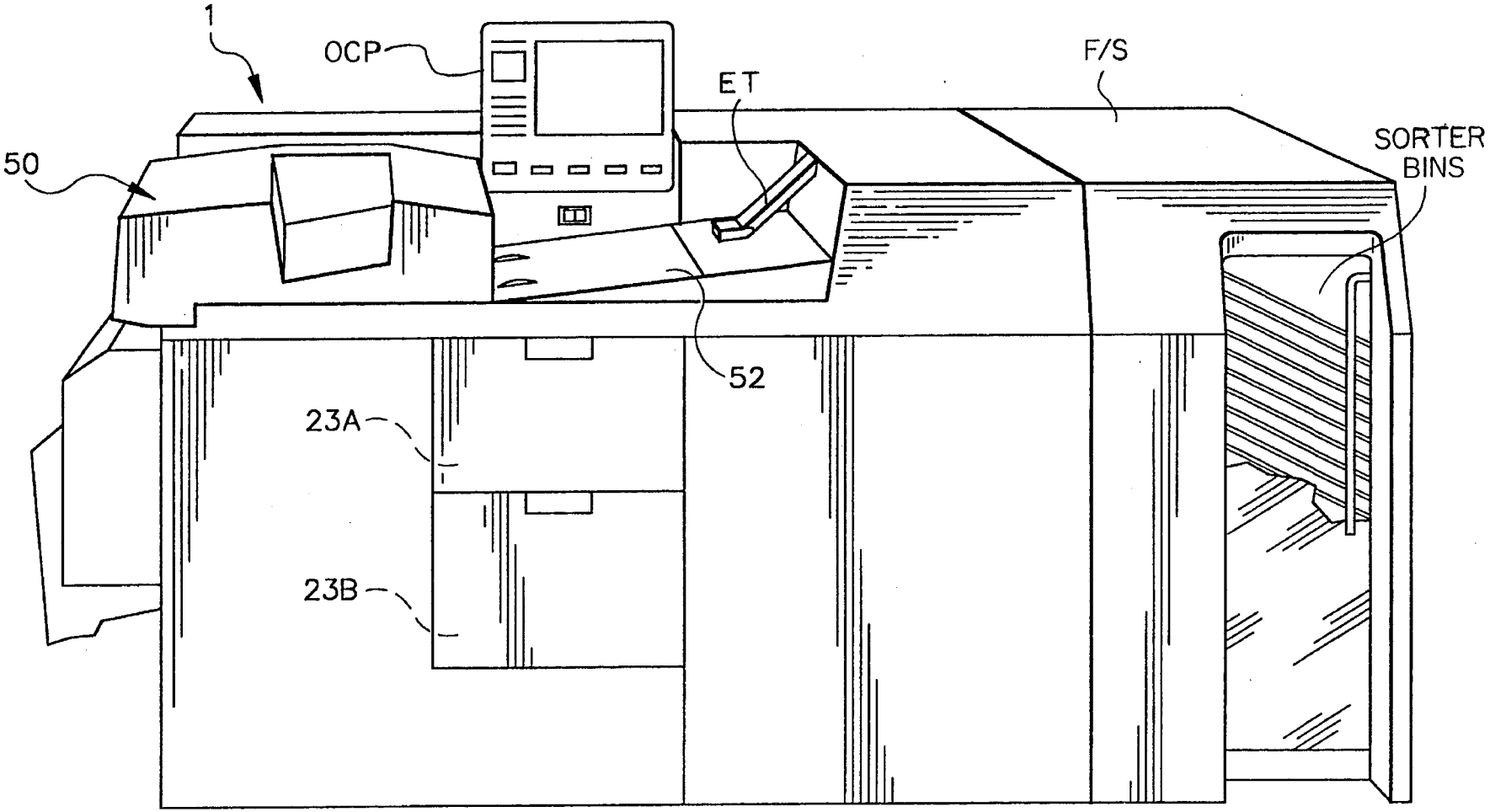
FIG. 1 is a front perspective view of an electrostatographic reproduction apparatus for incorporating the present invention.

With reference now to FIG. 1, there is shown an electrostatographic reproduction apparatus 1 having a recirculating document feeder 50 that includes a tray portion for accepting a multi-sheet document original for reproduction. The apparatus 1 includes an operator control panel (OCP) which, as will be described, includes buttons and prompting displays for facilitating a job setup: i.e., the input of an instruction set to the apparatus logic and control unit (LCU) to enable it to control a series of operations resulting in a desired copy output representing a reproduction of the document originals. Copies may be produced on receiver sheets stored in either or both drawers holding trays 23*a* and 23*b*. The copy output from the apparatus is stored either in an exit tray (ET) or a finisher/sorter (F/S) having a series of sorter bins, as is well known.

Figure 2:
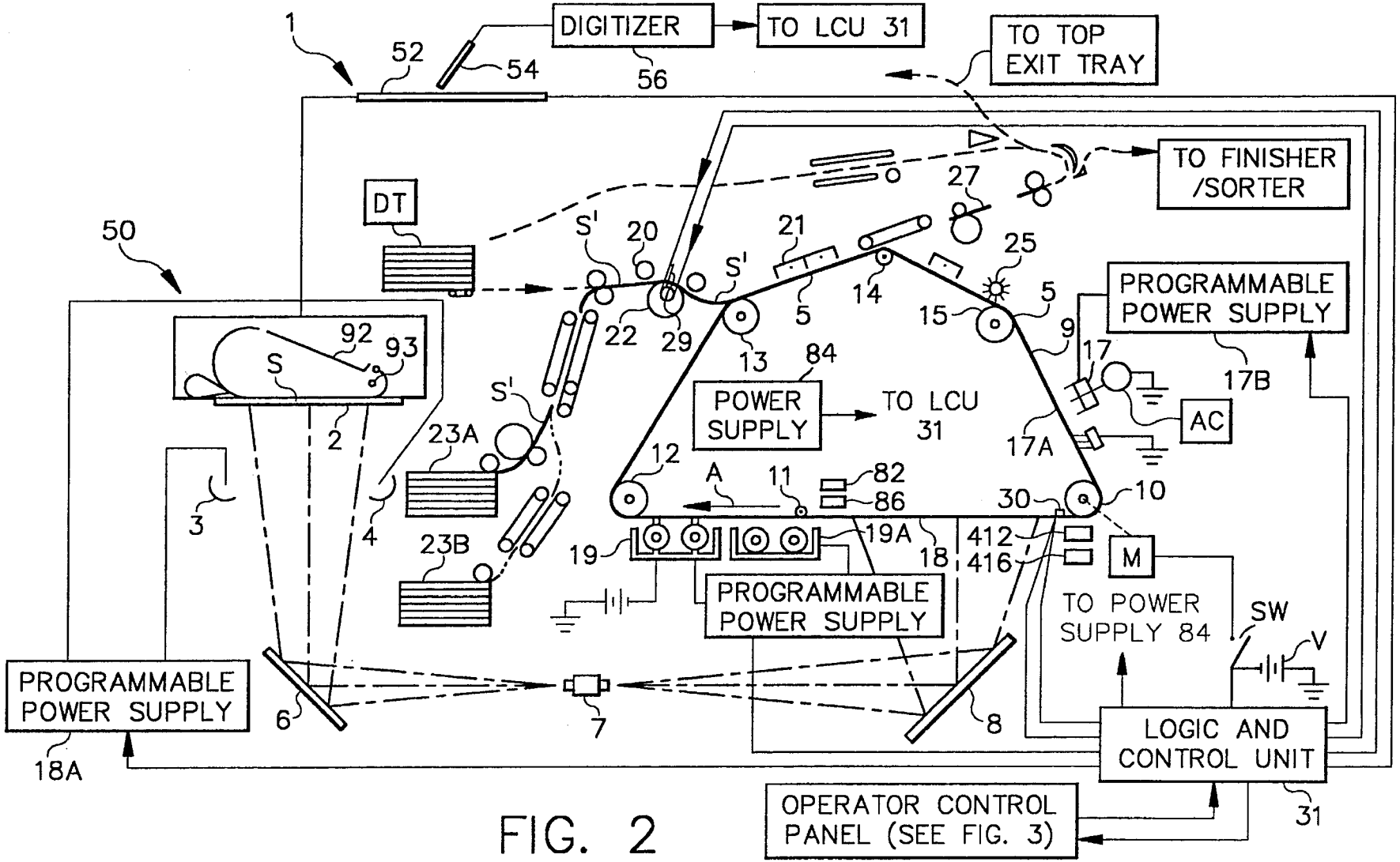
FIG. 2 is a schematic diagram of the electrostatographic reproduction apparatus of FIG. 1.

Referring now to FIG. 2, the electrostatographic reproduction apparatus of FIG. 1 incorporating the present invention will be described in greater detail. As shown, reproduction apparatus 1 includes a photoconductive web 5 that is trained about six transport rollers 10, 11, 12, 13, 14 and 15, thereby forming an endless or continuous web. Roller 10 is coupled to a drive motor M in a conventional manner. Motor M is connected to a source of potential V when a switch SW is closed by a logic and control unit (LCU) 31. When the switch SW is closed, the roller 10 is driven by the motor M and moves the web 5 in clockwise direction as indicated by arrow A. This movement causes successive image areas of web 5 to sequentially pass a series of work stations of the apparatus 1. These workstations include: a charging station 17,17*a* at which the photoconductive surface 9 of the web 5 is sensitized by applying to such surface a uniform electrostatic charge of a predetermined voltage; an exposure station 18 at which a light image of a document sheet S, supported on transparent platen 2, is projected by mirrors 6, 8 and lens 7 onto the photoconductive surface 9 of the web 5 to produce a latent electrostatic image of the document sheet. Also included are a magnetic brush development station 19 at which the latent image is developed with developer which may consist of iron carrier particles and electroscopic toner particles with an electrostatic charge opposite to that of the latent electrostatic image, to form a toner image on web 5. A transfer station, including a corona charger 21 transfers the toner image on web 5 to a copy sheet S' which is transported to a heated pressure roller fuser 27 where the toner image is fixed to copy sheet S'. The sheet S' containing a fixed toner image is fed to a finisher/sorter or a top exit tray.

A cleaning station 25 is provided to clean the photoconductive surface 9 of web 5 of any residual toner particles remaining after the toner images have been transferred.

Copy sheet S' is fed from one of supplies 23*a* or 23*b* to continuously driven rollers 20 which urge sheet S' against a rotating registration finger 29 of a copy sheet registration mechanism 22, from which it is fed to the transfer station 21.

Apparatus 1 includes an additional color development station 19*a*, a duplex tray DT and a digitizer, including digitizer tablet 52, wand 54 and circuit 56 which provide digital signals to LCU 31.

Figure 3:
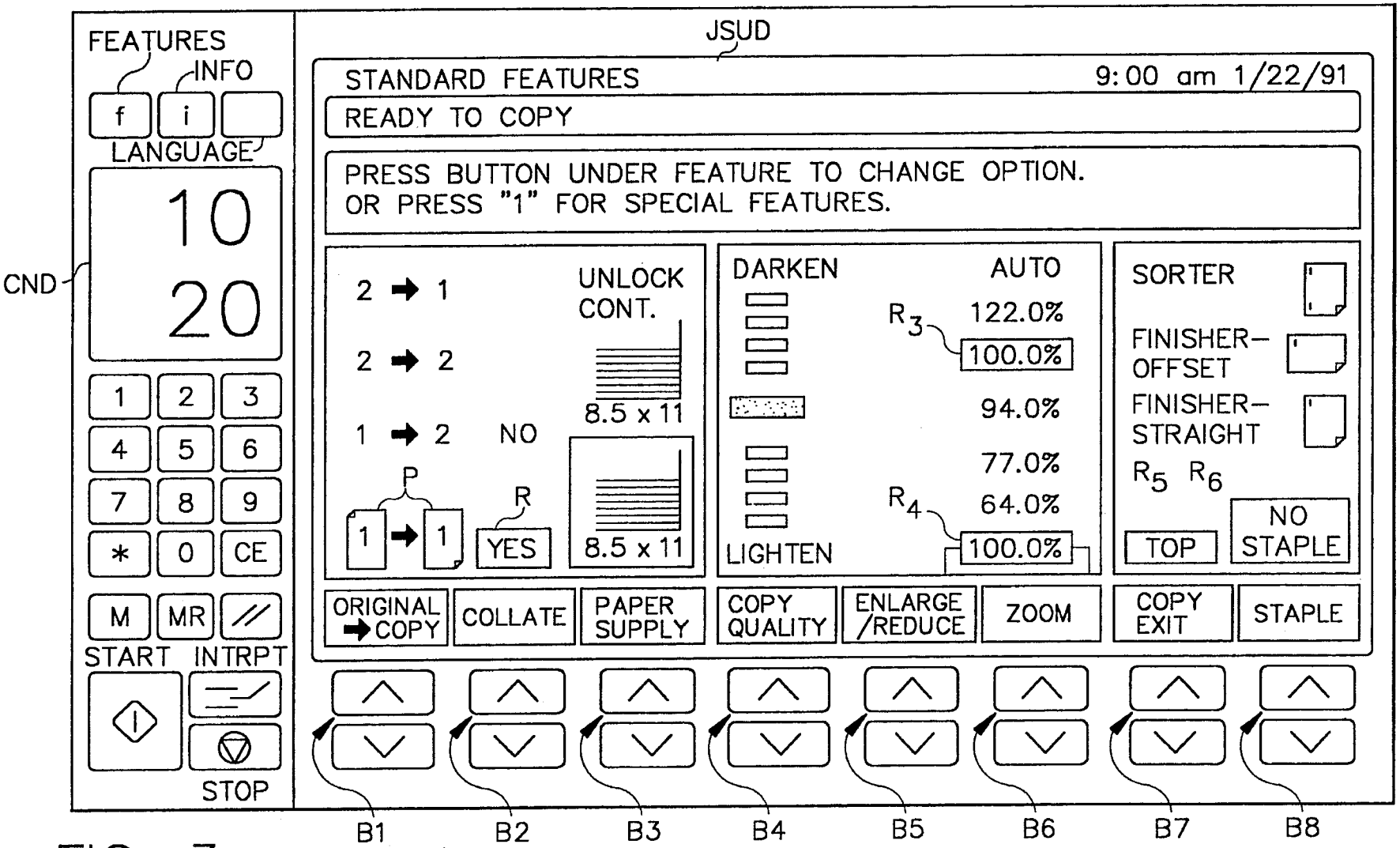
FIG. 3 is a diagrammatic view of an operator control panel, including a display screen with the display on the screen illustrating a standard features screen of the apparatus of FIG. 1.

Referring now to FIG. 3, there is shown an operator control panel (OCP) which includes various buttons or keys to allow operator input and control of apparatus 1. The operator control panel includes two displays, a copies numerical display (CND) and a job setup display (JSUD). The numerical display indicates the number of copies or sets requested, as well as the number of copies or sets that have been completed. The job setup display screen is a known programmable type screen wherein LCU 31 includes a computer program and a bit map memory for controlling the representation that is visible on the display.

The operator selectable buttons on the left hand side of the OCP include, at the top, a FEATURES (f) button, an INFORMATION (i) button, and a LANGUAGE button. Below the CND display are numerical buttons 0–9 to set the number of copies or sets to be copied. A * and CE (clear entry) keys are also included. At the bottom are a START button, an INTERRUPT button, a STOP button and, above these buttons, memory (M), memory recall (MR), and reset (//) buttons.

The display illustrated on the JSUD display in FIG. 3 is referred to as the "standard features display" as it displays various features that a casual user of the apparatus 1 would want when first approaching the apparatus for an average reproduction job. The job features shown are original-copy, collate, paper supply, copy quality, enlarge/reduce, zoom, copy exit, and staple. A series of up/down button sets B1–B8 are located below the JSUD display. The features may be selected by an operator by operation of the appropriate up-down button set B1–B8. For example, operation of the copy quality up-down button set B4 cause the selections to progressively sequence from lighten to darken copy. The signals generated by the up-down buttons represent a request for input to the LCU 31 to change the display by one increment for each depression of the button in the desired direction. The LCU 31 may have a program that allows a depression of a button to scroll from a top-most option directly to a bottom-most option when the up button is pressed.

Figure 4:
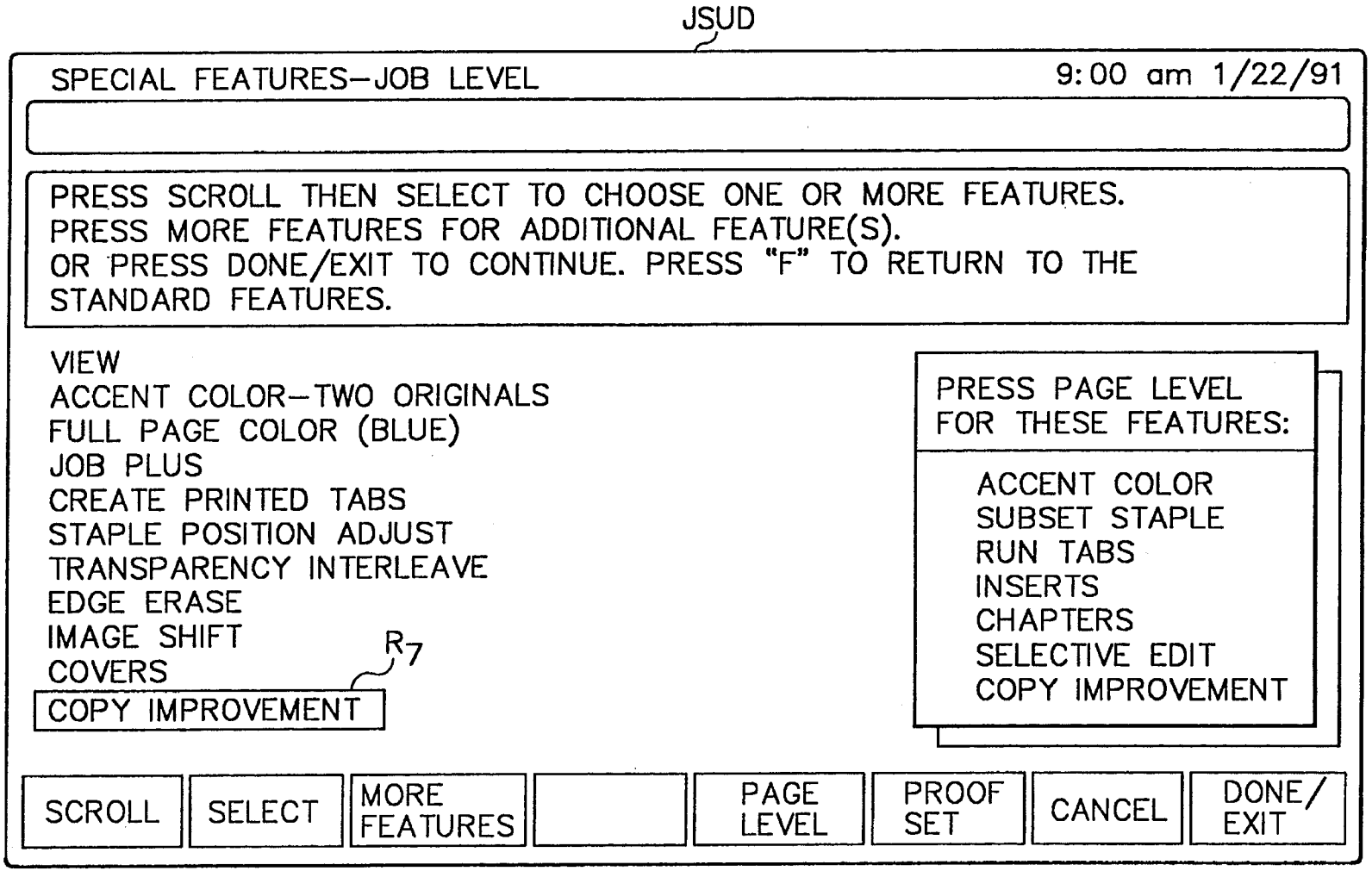
FIGS. 4–12 are respective display screens useful in explaining the present invention.

It will be noted that the JSUD display, in combination with the CND display, provides sufficient display of the standard features to facilitate input of an average copying job to be requested by a casual user of the apparatus. The standard features display includes additional word instructions and information as illustrated, including instructions to press a FEATURES button "f" for special features. Upon pressing the button f, a screen display, as illustrated in FIG. 4, is called up on the JSUD display from a stored program in LCU 31. The JSUD display of FIG. 4 includes a vertical arrangement of word descriptions of selectable special features that are available on a job-level basis. These features are described in greater detail in the aforementioned U.S. Pat. No. 5,113,222. By using the SCROLL up/down buttons B1, the rectangle which is illustrated as surrounding the words "Copy Improvement" is moved to surround the word "VIEW".

According to the present invention, using the VIEW special features option, the operator can add an alphanumeric stamp (notes, time, date, page number— in black or color accents) to specific locations on copies produced on the apparatus 1 without the use of a standard computer keyboard.

Figure 5:
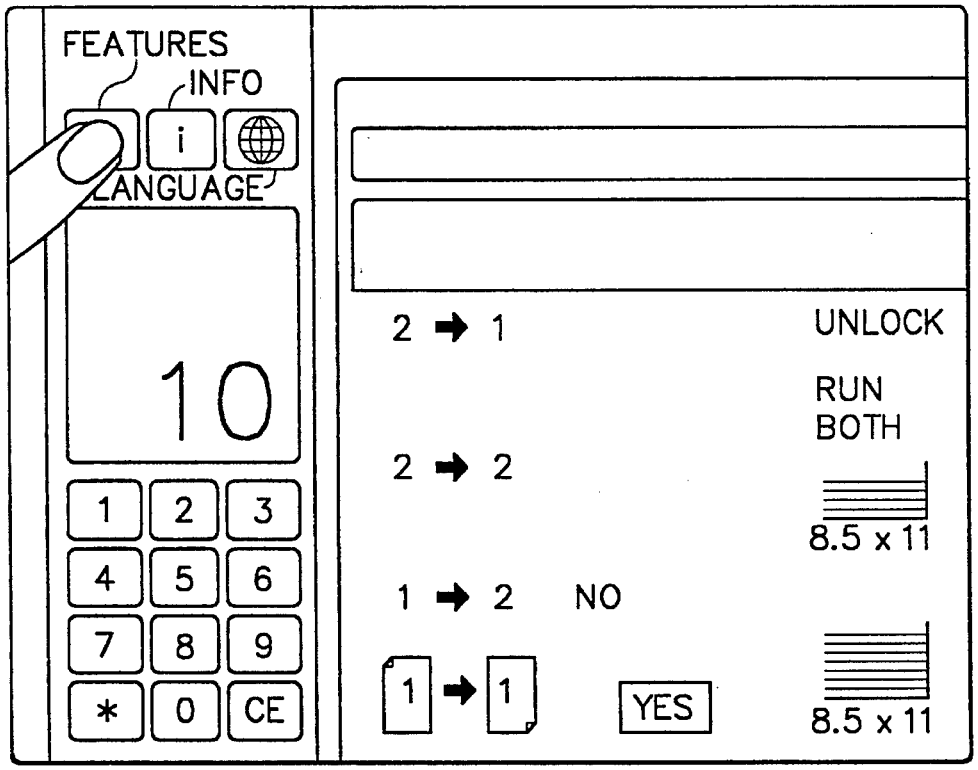
Figure 6:
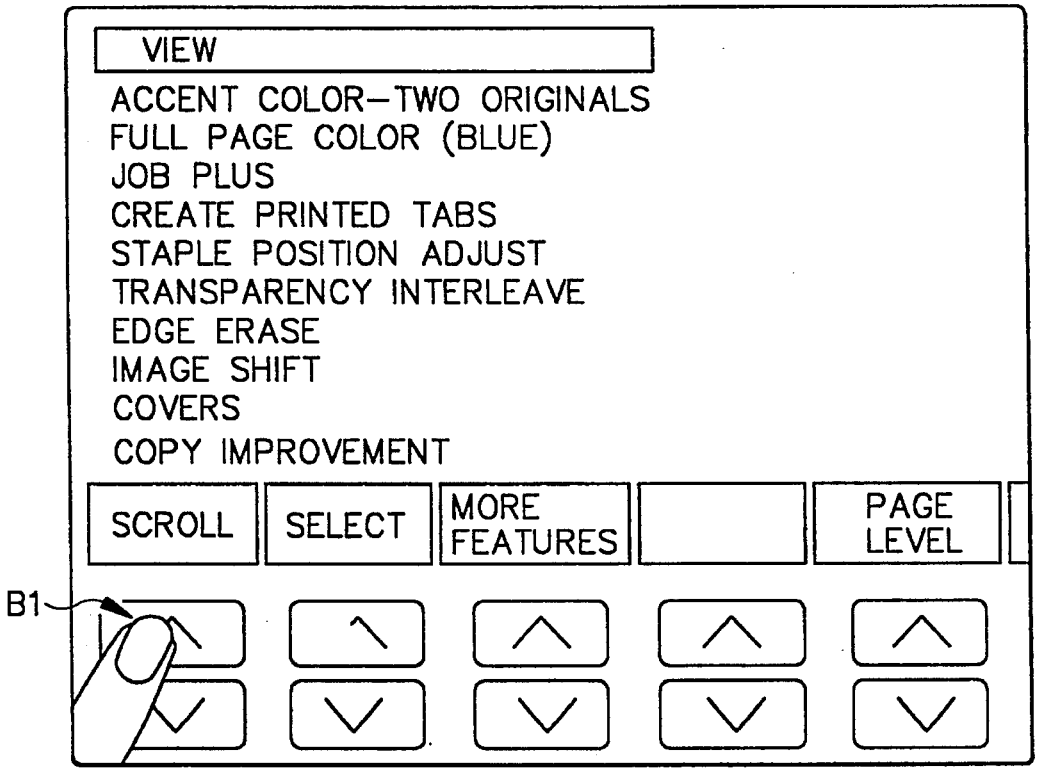
Figure 7:
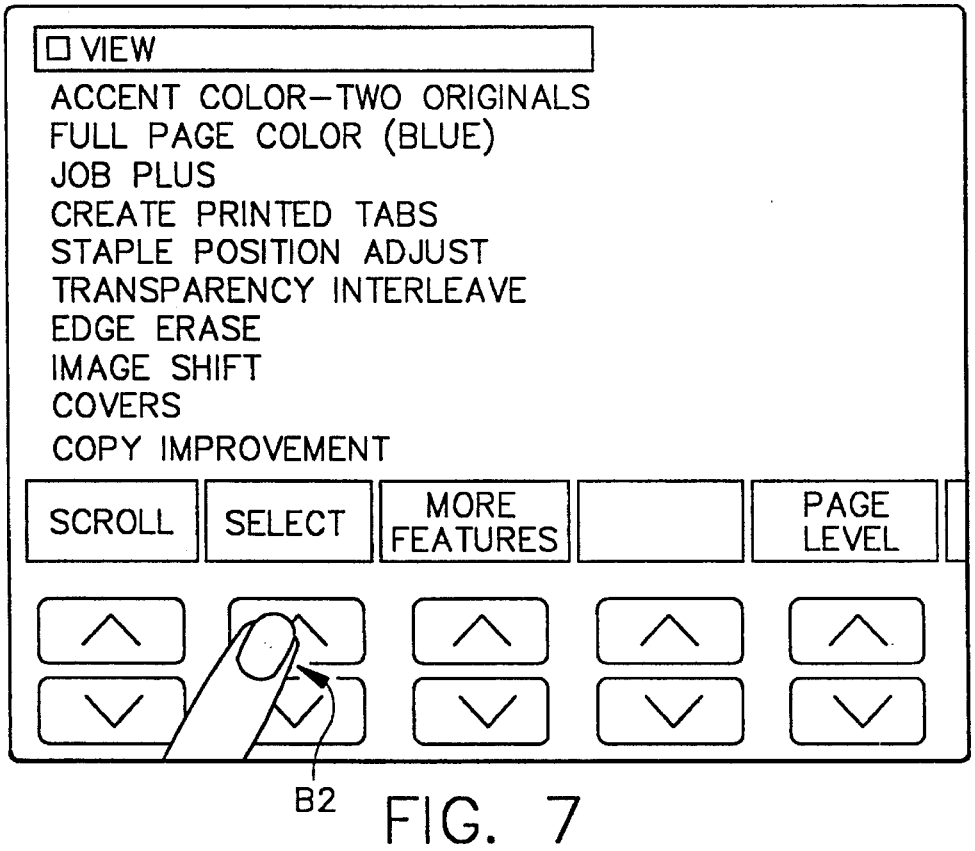
Figure 8:
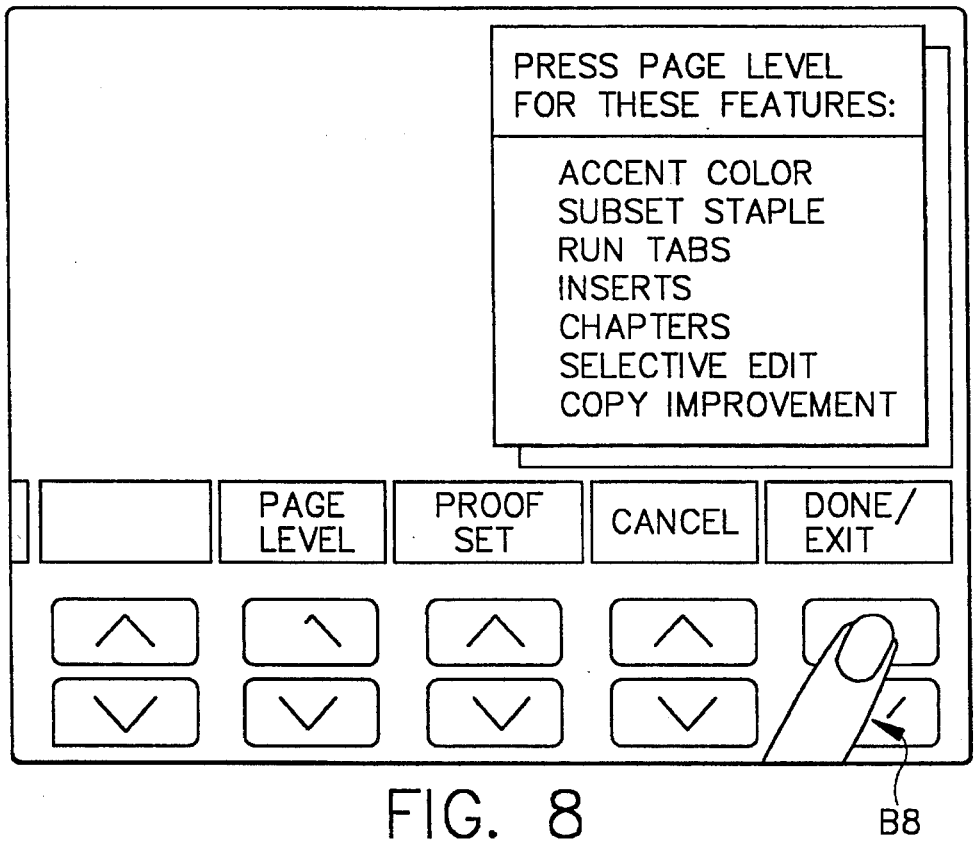

Reference is now made to FIGS. 5–12 for an explanation of an embodiment of the present invention. In order to call up the stamp feature of the present invention on the JSUD display, the operator first presses the FEATURES "f" button for the special features screen (FIG. 5). Next, the operator presses the SCROLL button B1 to move the scroll box through features until "VIEW" is in the scroll box (FIG. 6). The operator then presses the SELECT button B2 to choose the VIEW feature. A small hollow box appears next to VIEW to show the operator that this feature has been selected (FIG. 7). Pressing the "DONE/EXIT" button B8 (FIG. 8), calls up the VIEW screen.

Figure 9:
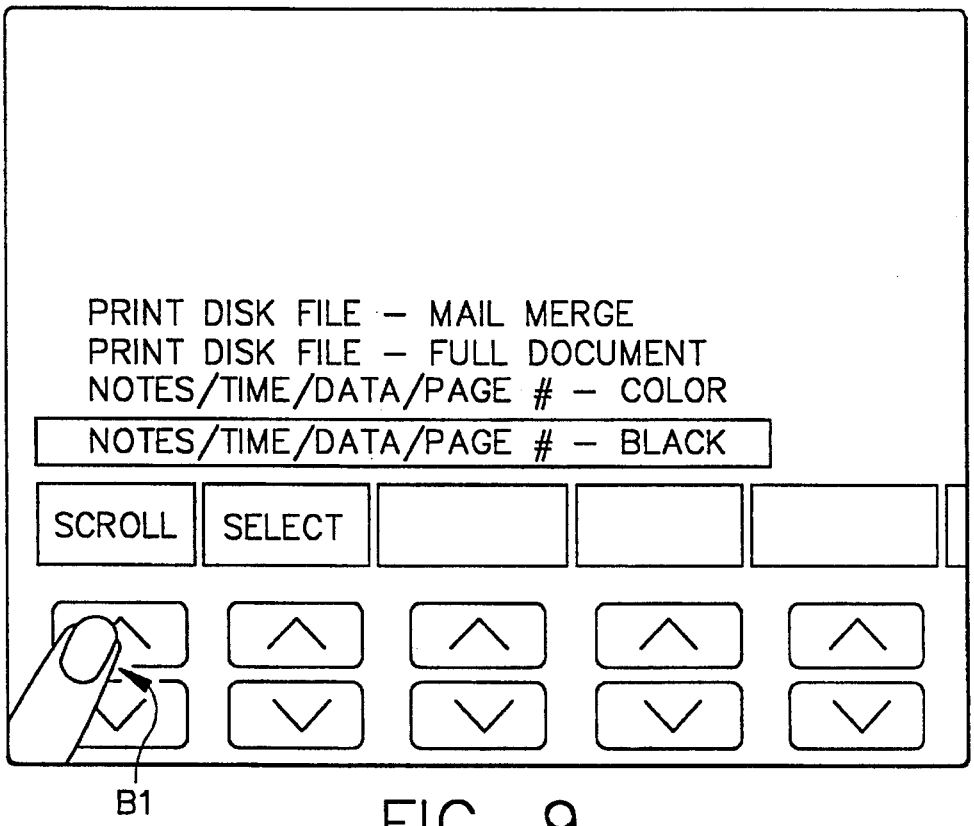

As shown in FIG. 9, the VIEW screen lists four options. An operator presses the scroll button B1 to move the scroll box through features until either the "NOTES/TIME/DATE/PAGE NUMBER/BLACK" or "NOTES/TIME/DATE/PAGE NUMBER/COLOR" feature is in the box. The BLACK option allows one to print all of the notes, time, date, page number (stamp) information using black only. The COLOR option allows one to use any color available on apparatus 1 (development station 19*a*—FIG. 2) to print this information. If this option is picked, the lines at the top, for example, will be in color while the lines at the bottom will be in black (FIG. 9).

Figure 10:
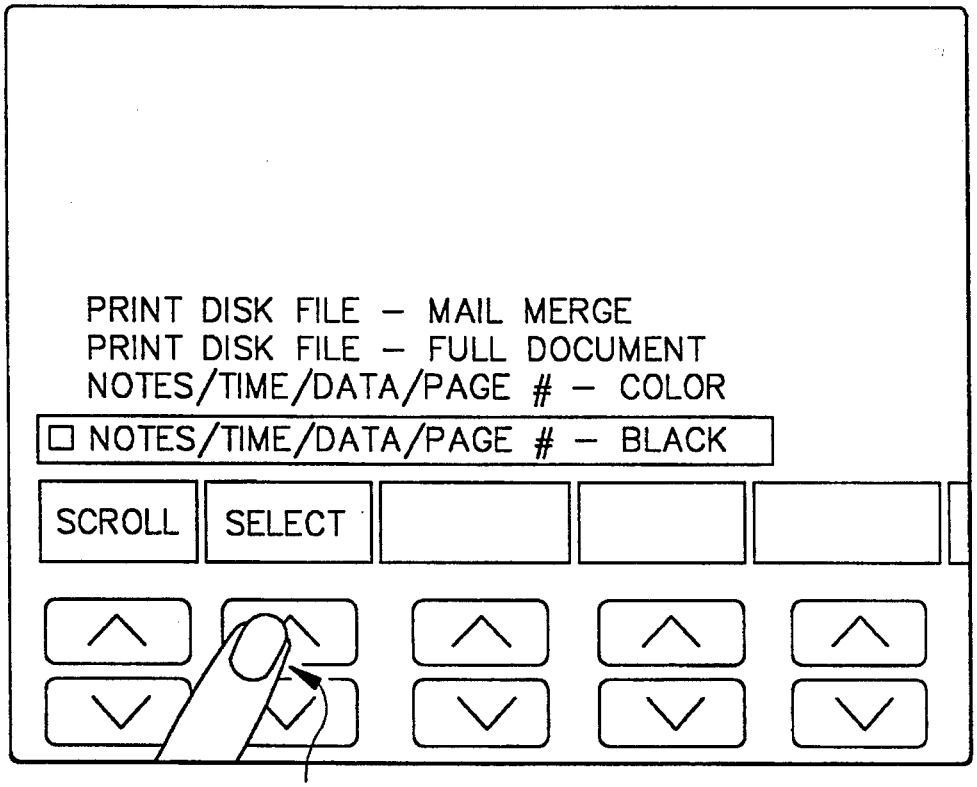

As shown in FIG. 10, by pressing the SELECT button B2 to choose the feature that one wants, a small hollow box appears to show the operator which feature has been selected (as shown, the BLACK feature). Thereafter, the operator presses the "DONE/EXIT" button B8 after an option has been selected.

Figure 11:
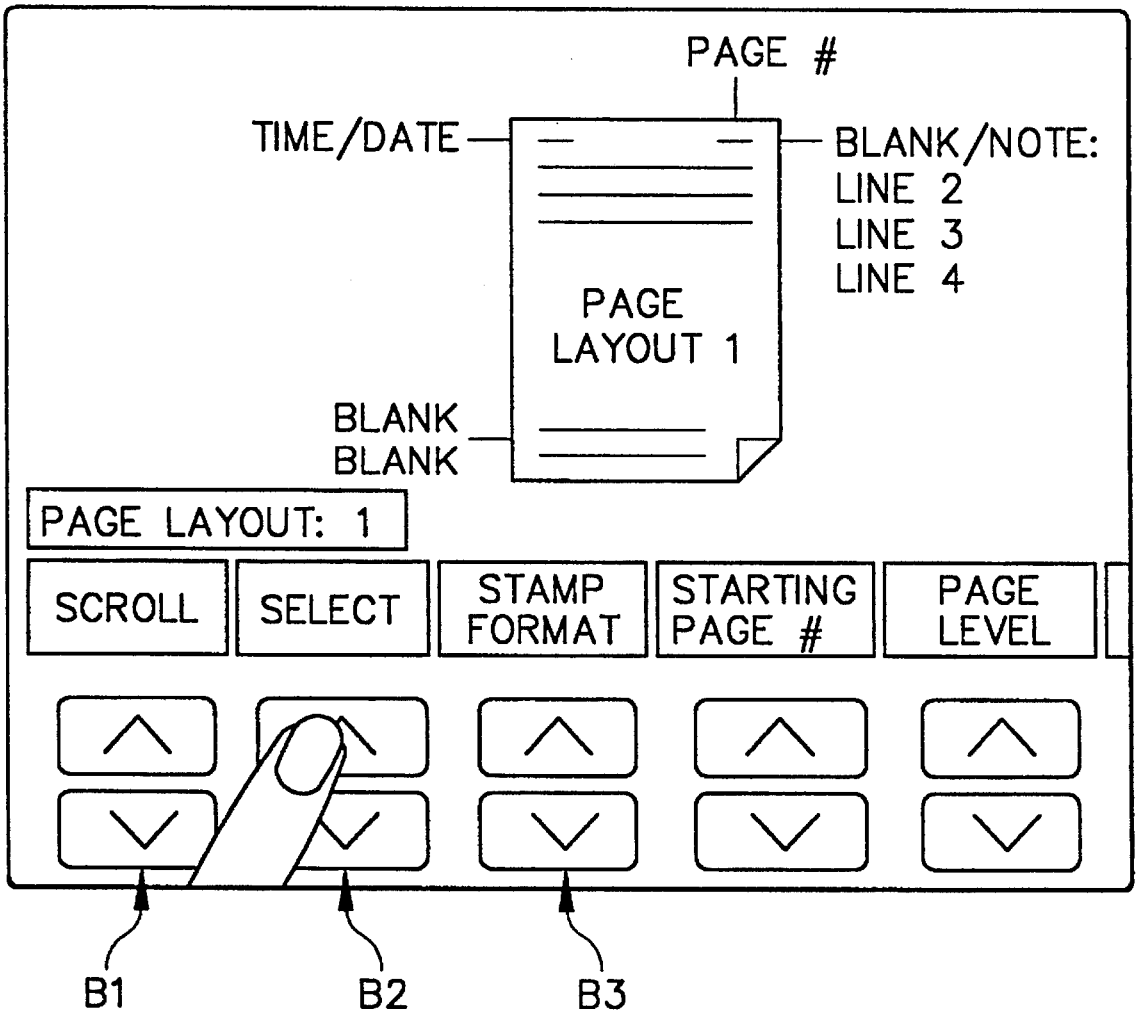

FIG. 11 shows the screen displayed on the JSUD display which allows the addition of alpha-numeric characters and other symbols at the top and bottom of a page. By pressing the SCROLL button B1, then the SELECT button B2 to choose a page layout, the page layout number 1 is selected. By pressing the STAMP FORMAT button B3, the screen of FIG. 12 is displayed on the JSUD.

Figure 12:
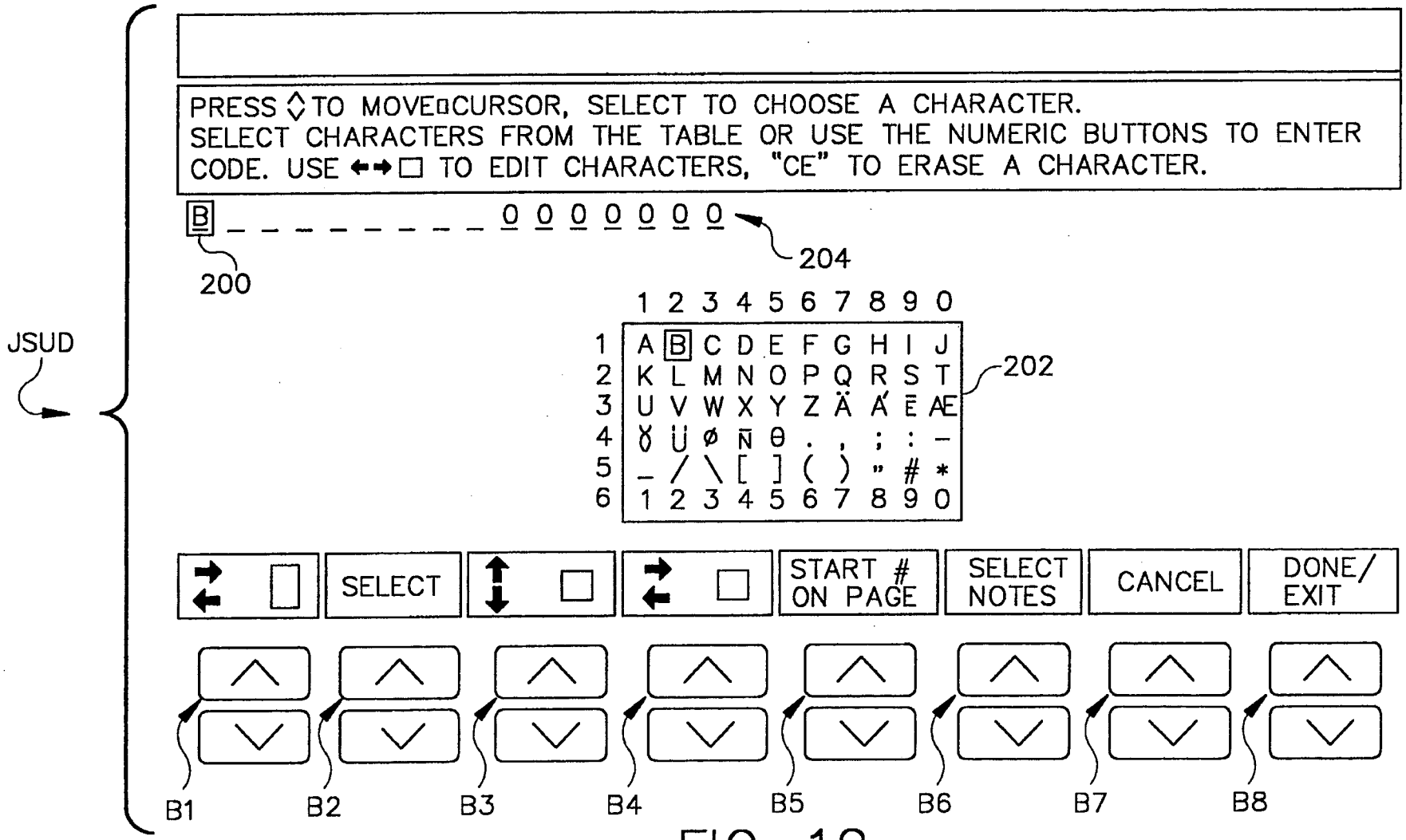

As shown in FIG. 12, according to one embodiment of the present invention, there is displayed a set of alpha-numeric characters and symbols, arrayed as a matrix or table 202, which allow the user to select the desired characters and symbols to be added to a page using one or more of several integrated selection techniques. The actual layout of characters and symbols in the table 202 is somewhat arbitrary and this layout can be optimized for any given application, especially with respect to the number of rows versus columns and the location of frequently used characters within the table 202. As shown, each column and row of table 202 is numbered.

In the embodiment shown, the user creates the variable text (stamp) to be printed in the field area 204 shown on the upper left of the screen. The actual length of this text is dependent only on the printing technology. A small box is shown as the "current field" cursor 200.

The left-most button B1 in the display (shown with right and left pointing arrows) is used to edit the "stamp". The user can press the upper portion of the button B1 to move one character at a time to the right and the lower portion of the button B1 to move one character at a time to the left. Movement across existing characters is nondestructive, that is, existing characters in the stamp are not erased by simply backspacing over them. The existing clear entry (CE) button on the numeric keypad (FIG. 3) is used to erase a character. The cancel button set (B7) is used to erase all fields in the stamp and return the JSUD screen to its initial state. The DONE/EXIT button B8 is used to exit the screen and save the existing stamp for the job.

In a preferred embodiment of selection, a user presses the up/down and left/right buttons B3, B4 until the desired character is highlighted (B in FIG. 12). By then pressing the SELECT button B2, the current character is caused to be written to the current field and the current field cursor box 200 to be moved one character to the right.

In a second method of selection, the user enters a unique two-digit column-row code using the numeric keypad (FIG. 3) for each character that is required. As illustrated in FIG. 12, in order to select a "B", the user would enter the column number-2 followed by the row number-1. Pressing the SELECT button B2 causes the current character to be written to the current field and the current field cursor box 200 to be moved one character to the right. Likewise, it is possible to implement this method of selection by using a row-column code.

In a third method of selection, the digitizing tablet 52 and wand 54 (FIG. 2) are used to choose the stamp characters. Several options are available: 1) a permanent overlay with the available characters and symbols is attached to the editing surface of tablet 52 and the user selects the desired characters by touching the wand 54 to the character on the digitizing tablet 52; 2) a variable overlay is printed by apparatus 1 which contains the available characters and symbols plus special registration marks, the user registering the printed character set on the digitizer tablet 52 and selecting the desired characters with wand 54; 3) a table of the available characters and symbols is presented on the display screen as illustrated in FIG. 12 with a cursor that the user is able to move by pressing the wand 54 to tablet 52 to select the desired characters.

The several methods of selection can be presented to the user in combination allowing the user to select that method which best meets his or her needs.

Once the stamp has been selected by the operator, the LCU 31 (FIG. 2) exposes the photoconductive surface 9 of web 5 by means of LED bar 416 and radiant index lens array 412 in accordance with signals provided from LCU 31. Alternatively, a laser imaging device or liquid crystal display imaging device can be used to effect the stamp exposure.

The primary advantages of the present invention are: 1) full alpha-numeric input of any language or symbol set can be provided without a standard computer keyboard; 2) the user can see at one time all of the characters that are available for selection; 3) the user can choose that method which best suits his or her needs and level of experience; 4) the number of keystrokes for user inputs required to create a stamp can be minimized by the user's choice of methods.

The invention has been described in detail herein with reference to the figures, however, it will be appreciated that variations and modifications are possible within the spirit and scope of the invention.

What is claimed is:

1. A reproduction apparatus for producing copy, said apparatus comprising:

an operator control panel, said panel including a display screen for indicating on said screen certain standard selectable features for producing a copy, with plural displayed options for each feature, and first means for altering the display on the screen to indicate a displayed selected option and generating a first set of signals representing selected options of the standard features;

means for altering the display on said screen to display a set of alpha-numeric characters and/or symbols, and second means for altering the display on the screen to indicate one or more selected alpha-numeric characters and/or symbols and generating a second set of signals representing selected alpha-numeric characters and/or symbols; and means responsive to said first and second sets of signals for producing a copy having said one or more selected alpha-numeric characters and/or symbols in a predetermined location on said copy.

2. The apparatus of claim 1 wherein said set of alpha-numeric characters and/or symbols are displayed in a matrix on said screen, and wherein said second means for altering the display on the screen includes operator actuatable button means for scrolling through the displayed matrix of characters and/or symbols and for selecting said one or more selected characters and/or symbols.

3. The apparatus of claim 1 wherein said set of alpha-numeric characters and/or symbols are displayed in a matrix of uniquely numbered rows and columns on said screen, and wherein said second means for altering the display on the screen includes an operator actuatable numeric keypad, which the operator uses to enter a unique two digit column/row code for each alpha-numeric character and/or symbol to be selected.

4. The apparatus of claim 1 wherein said set of alpha-numeric characters and/or symbols are displayed on said screen, and wherein said second means for altering the display on the screen includes a digitizing tablet and wand that can be used by pressing the wand to a selected area of said digitizing tablet to select the desired character/symbol.

5. In apparatus for reproducing a copy of an original and for adding alpha-numeric characters and/or symbols to said copy in a designated copy area, the improvement comprising:

a display screen on said apparatus for displaying a set of alpha-numeric characters and/or symbols;

operator actuatable input means for altering the display screen to indicate one or more selected alpha-numeric characters and/or symbols and for causing said selected alpha-numeric characters and/or symbols to be added to a designated area of a reproduced copy; and wherein said operator actuatable input means includes operator actuatable button means for scrolling through the displayed set of characters and/or symbols and for selecting said one or more selected characters and/or symbols.

6. The improvement of claim 5 wherein said set of alpha-numeric characters and/or symbols are displayed on said display screen in a matrix of uniquely numbered rows and columns on said screen, and wherein said operator actuatable input means includes an operator actuatable numeric keypad, which the operator uses to enter a unique two digit column/row code for each alpha-numeric character and/or symbol to be selected.

7. The improvement of claim 5 wherein said operator actuatable input means includes a digitizing tablet and wand that can be used by pressing the wand to a selected area of said digitizing tablet to select the desired character/symbol.

* * * * *